United States Patent [19]

Hinkle et al.

[11] 3,949,571

[45] Apr. 13, 1976

[54] ELASTIC YARN BINDER AND CUTTER

[75] Inventors: Harry J. Hinkle, Spruce Pine; Mack E. Wilson, Bakersville; Jack H. Wade, Spruce Pine, all of N.C.

[73] Assignee: Hampshire-Designers, Inc., Manchester, N.H.

[22] Filed: Nov. 29, 1974

[21] Appl. No.: 528,153

[52] U.S. Cl. ..... 66/140 S; 66/145 S; 83/387

[51] Int. Cl.[2] ..... D04B 35/00; D04B 15/50

[58] Field of Search ..... 66/140 S, 145 S, 140 R, 66/145 R, 134, 142; 83/387, 389

[56] References Cited

UNITED STATES PATENTS

| | | | |
|---|---|---|---|
| 1,559,911 | 11/1925 | Powell | 66/134 |
| 1,970,072 | 8/1934 | Bentley et al. | 66/134 |
| 2,000,194 | 5/1935 | Shelmire | 66/134 |
| 2,270,432 | 1/1942 | Fregeolle | 66/134 |
| 2,448,498 | 8/1948 | Shortland | 66/134 |
| 3,006,173 | 10/1961 | Shoaf | 66/140 S |
| 3,246,489 | 4/1966 | Della Bella | 66/145 R |
| 3,257,829 | 6/1966 | Parthum | 66/140 S |
| 3,322,013 | 5/1967 | Felix | 83/387 |
| 3,331,220 | 7/1967 | Bastuscheck et al. | 66/134 |
| 3,367,146 | 2/1968 | Allred | 66/140 S |
| 3,379,036 | 4/1968 | Farmer | 66/145 R |
| 3,668,899 | 6/1972 | Grewcock et al. | 66/140 S |
| 3,714,799 | 2/1973 | Minton | 66/140 S |
| 3,760,608 | 9/1973 | Lonati | 66/140 S |

FOREIGN PATENTS OR APPLICATIONS

| | | | |
|---|---|---|---|
| 1,007,670 | 10/1965 | United Kingdom | 66/140 R |
| 742,536 | 12/1955 | United Kingdom | 66/134 |

*Primary Examiner*—Mervin Stein
*Assistant Examiner*—Andrew M. Falik
*Attorney, Agent, or Firm*—Wolf, Greenfield & Sacks

[57] ABSTRACT

A circular knitting machine has a device for cutting and holding elasticized yarns, such as spandex. The device enables the yarn, when detached from the knitting needles, to be cut while holding the free, cut end of the yarn firmly in position so that the yarn later may be easily reattached to the knitting needles when it is desired to reintroduce the spandex yarn into the knit fabric. The device includes a pair of jaws movable in unison, one jaw being effective to grip the yarn and the other jaw thereafter being effective to cut the gripped yarn.

7 Claims, 14 Drawing Figures

ELASTIC YARN BINDER AND CUTTER

BACKGROUND OF THE INVENTION

In circular knitting machines having a plurality of vertically reciprocable knitting needles arranged in a circle it often is desirable to knit fabrics in which different portions of the fabric are knitted from different types of yarn. Typically, a circular knitting machine will be associated with a plurality of spools of various types of yarns. Each of the yarns is guided to and held in proximity to the circular array of knitting needles by movable yarn feed fingers located outside the needle circle. The end of the yarn is held at a location within the needle circle so that when viewed in plan, the yarn intersects the needle circle. When it is desired to introduce a particular type of yarn into the knitted fabric, the feed finger which guides that particular yarn may be moved from its remote, upper position in which the yarn is above the needles to a lowered position in which the yarn is engaged by the needles thus enabling the yarn to be incorporated into the knitted fabric. When it is no longer desired to employ that yarn in the fabric, the feed finger guiding the yarn is raised to its remote position which withdraws the yarn from further engagement with the knitting needles. Typically, means are provided to cut the yarn after it has been detached from the needles and means are provided to hold the cut end of the yarn to facilitate reintroduction of the yarn into the fabric when desired.

It has been common practice with non-elastic yarns to move the yarn feed finger to the remote position, thus disengaging the yarn from the needle, then drawing the disengaged portion of the yarn across a suction inlet and then cutting the yarn at a location beyond the suction inlet. The suction inlet is connected to a vacuum pump and after the yarn has been cut, its free end is ingested into the suction inlet to hold the free end of the yarn under light tension. The suction inlet and yarn feed finger cooperate to hold the end of the yarn above the needles and the needle circle in readiness to reintroduce the yarn into the fabric. Once the yarn has been re-engaged with the knitting needles operation of the knitting needles easily draws the previously cut end of the yarn out from the suction inlet and to a cutting station where the free end can be severed from the portion of the yarn which has been knitted into the fabric.

It sometimes occurs that the cut end of the yarn is not held properly and this may result in some very serious difficulties. If the cut end of the yarn is not held properly within the needle circle but instead hangs loosely from the yarn feed finger, it will not be in a proper position to be reattached to the needles when the yarn feed finger moves downwardly to the yarn re-engaging position. Continued operation of the machine without proper engagement of the yarn with the needles results in an improperly knit, faulty garment. When this occurs after part of the garment has been knit, all of the yarn used in that part of the garment is wasted. This can be relatively expensive if it happens often enough. In addition, many circular knitting machines have an automatic shut-off feature in which the machine shuts down should the knitting needles miss or not properly engage the yarn. Shutdown of the machine often is a somewhat rapid procedure and because of the delicacy of the needles and some of the other parts of the knitting machine this sometimes results in breakage of some of these parts. This, in turn, results in substantial down time of the machine which also is obviously undesirable.

In general, the vacuum holding technique described above has proved satisfactory for relatively inelastic yarns. The difficulties described above, however, become particularly acute with stretchable elastic yarns of the type used in stretch fabrics such as in panty hose, etc. In order for such stretch garments to have their stretch quality they must be knit with the elastic yarn in a highly tensioned and stretched configuration. This is required so that after the fabric has been knitted, it will contract under its own elasticity so that it may thereafter stretch from its contracted state. Because the yarn is highly stretched during the knitting process, when it is cut it tends to contract and withdraw from the vacuum inlet so that often it cannot be held by the conventional vacuum holding technique described above.

Efforts have been made to solve the above difficulty encountered with the cutting and holding elastic yarns. To this end a special mechanical device has been employed with such yarns which mechanically cuts and grips the yarn. The device does present a number of serious difficulties in that while it is effective to cut the yarn, it does not maintain a reliable grip on the cut end of the yarn. Frequently the cut end of the yarn simply falls loosely about and it cannot be properly reintroduced to the knitting needles when desired which results in the difficulties described above. In addition, yarn waste is a significant factor with stretchable yarns which are considerably more expensive than yarns of the inelastic variety.

It is among the primary objects of the invention to provide an improved attachment to a circular knitting machine which cuts and grips the yarn, is extremely reliable and eliminates the above difficulties.

SUMMARY OF THE INVENTION

The invention resides in the provision of a special attachment which is mounted in the machine in the region of the dial assembly. The attachment is located so that after the yarn finger has been moved to its remote position, thus detaching the yarn from the needles by precluding further engagement of the yarn by subsequent needles, the continued rotation of the needles will draw the detached portion of the yarn into engagement with the cutting and holding attachment. The attachment includes a pair of jaws which are normally closed and which are opened to receive the detached portion of the yarn. With the yarn in the jaws, the jaws then close in sequence, the first jaw being effective to grip the yarn and the second jaw then being operated to cut the yarn beyond the point at which the first jaw grips the yarn. The cut is made on the far side of the yarn so that the end of the yarn will remain firmly gripped by the first jaw at all times. The jaws, which are normally closed, are opened momentarily to receive and cut the yarn by a cam which is timed in relation to the movement of the yarn fingers to their remote position. The yarn thus is cut while in a stretched configuration and is held in the stretched configuration until ready to be reintroduced into the knitted fabric.

It is among the objects of the invention to provide an improved cutter-binder for yarns in a circular knitting machine.

A further object of the invention is to provide an improved cutter-binder which is useful particularly in connection with the knitting of fabrics incorporating elastisized yarns.

A further object of the invention is to provide an improved cutter-binder which insures that a cut yarn will be held firmly and in position for subsequent reattachment to the knitting needles.

A further object of the invention is to provide an improved cutter-binder which minimizes the yarn waste.

A further object of the invention is to provide an improved cutter-binder which minimizes machine down time.

DESCRIPTION OF THE DRAWINGS

The foregoing and other objects and advantages of the invention will be understood more fully from the following further description thereof, with reference to the accompanying drawings wherein.

DESCRIPTION OF THE PREFERRED EMBODIMENT

Figure 1:
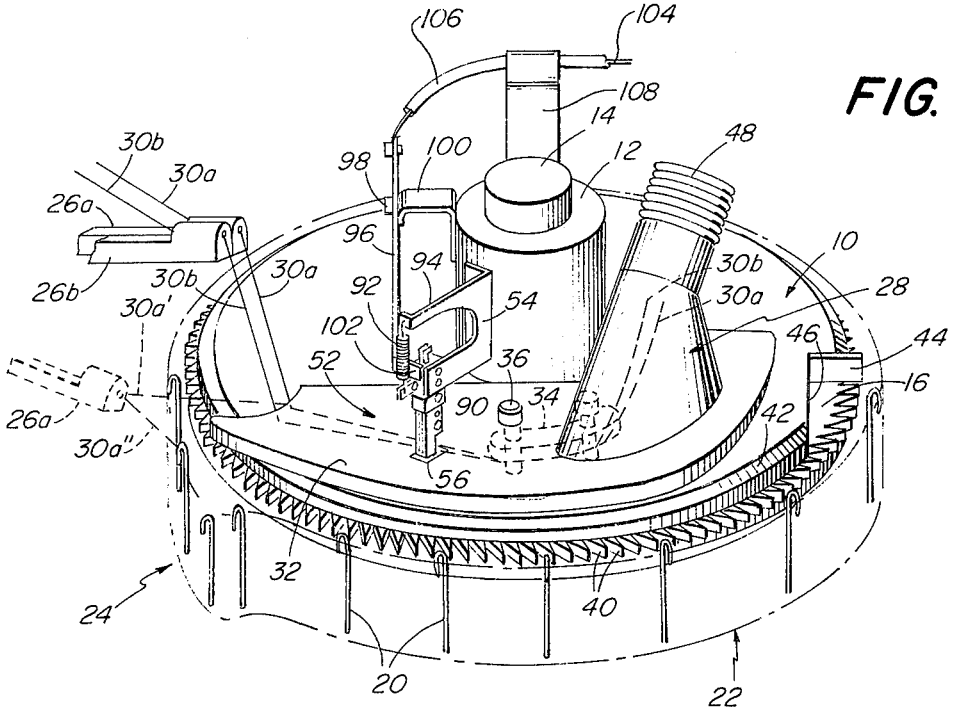
FIG. 1 is a somewhat simplified illustration of the dial region of a circular knitting machine in which the cutter-binder attachment of the invention is incorporated.
Figure 2:
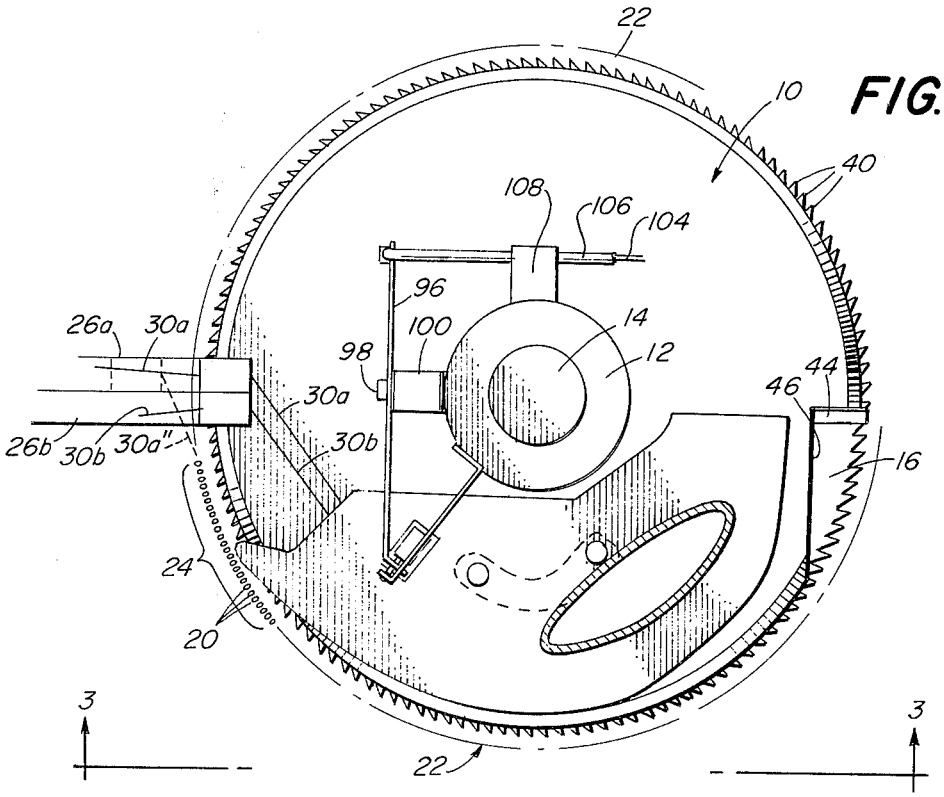
FIG. 2 is a plan view of the arrangement shown in FIG. 1.
Figure 3:
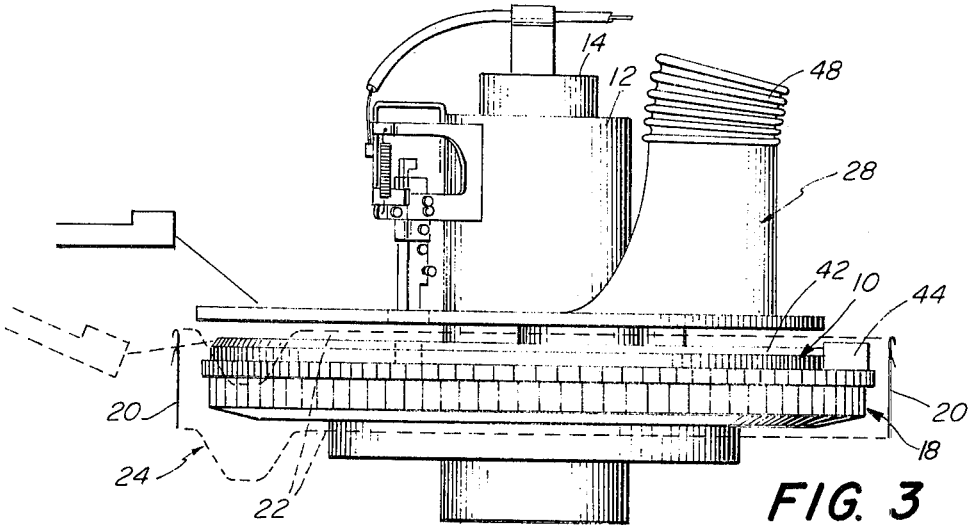
FIG. 3 is an elevation of the arrangement shown in FIG. 1 as seen along the line 3—3 of FIG. 2.

As shown in FIGS. 1–3 the circular knitting machine includes a dial top plate 10 which may have a central boss 12 rigidly secured to the top plate 10. A dial shaft 14 extends through the central boss and is connected to a cutter disk 16 and dial 18 disposed below the top plate 10 to rotate the disk 16 and dial 18 in unison below the stationary top plate 10. A plurality of knitting needles 20 are mounted on a conventional needle drum (not shown) to rotate the needles in a circle suggested at 22 and in a manner which effects vertical reciprocating movement of the needles 20 in one or more knitting waves, one such wave being suggested at 24 in FIG. 1. The machine also includes one or more feed stations spaced about the needle circle 22, each feed station including a plurality of yarn feed fingers 26. Each of the yarn feed fingers 26 holds and guides a yarn from one of a number of spools of yarn mounted about the machine. The yarn feed fingers 26 are individually movable between an upper, remote position in which the yarn is disengaged from the needles and a lower, operating position, shown in phantom in FIG. 3, in which the yarn is engaged by the needles and drawn and knitted into the fabric. Only one of the yarn feed fingers 26 is in a lower, operative position at any given time and the selection of the yarn feed fingers 26 at each station is controlled by cams in synchronization with the other elements of the machine as is well known in the art. Thus, by raising one of the yarn feed fingers 26 and lowering another of the yarn feed fingers at the same station, the type of yarn which is knitted into the fabric can be changed as desired to knit various patterns or to incorporate different types of yarns in different portions of a garment to provide different characteristics in those garment portions.

In order to insure that a yarn is properly engaged with the needles when its feed finger 26 is moved down to its operative position, the free end of the yarn must be held so that it extends across and above the needle circle 22 in readiness to be urged downwardly between a pair of adjacent needles in the needle circle. As mentioned above, one commonly employed technique to hold the free end of the yarn is to ingest it into a continuously operated vacuum nozzle 28. Thus, as shown in FIG. 1, yarn 30*a* is held in a position shown in readiness to be attached to the needle when its yarn feed finger is moved downwardly. In the embodiment shown, the vacuum nozzle 28 is formed integrally with a nozzle foot 32 which may extend over a substantial area over the dial top plate 10. The foot 32 is spaced above the top plate 10 and may be secured in the machine by any of a variety of ways. In the embodiment shown, the nozzle foot 32 is secured to the top plate through a yarn guide wall 34 which may also serve as a spacer between the nozzle foot 32 and dial top plate 10. The nozzle foot 32 and yarn guide wall 34 may be formed separately or may be integrally molded, and may be secured to the dial top plate by bolts 36 or other appropriate means.

When it is desired to introduce a yarn, such as yarn 30*a*, to the needles 20, yarn feed finger 26*a* is urged to its downward position as suggested in phantom in FIGS. 1 and 3. As shown in FIG. 1, when the yarn feed finger 26*a* is moved down, yarn 30*a* is inserted initially between a pair of adjacent needles in the circle, the yarn being in the position shown in phantom at 30*a*. As the needles rotate the yarn is drawn to the position indicated in phantom at 30*a*″, generally tangent to the needle circle 22, and remains in this attitude as it is continually drawn through the finger 26*a* into the rotating needles to knit the yarn into the fabric at the needle wave 24. As the knitting needles continue to rotate the trailing section of the yarn which extends from the first engaged needle to the tail end which is held in the vacuum inlet 28 rotates in unison with the needles between the top plate 10 and foot 32. Thus, when the needle which first engaged yarn 30*a* progresses to the positions indicated at 20*a*, 20*b*, 20*c*, 20*d*, etc. the tail end of the yarn still will remain drawn into the vacuum inlet 28. It may be noted that the tail end of the yarn between its ingested end and the point where it is knitted into the fabric is caught on one of the radially outwardly protruding teeth 40 of the cutter disk 16. The outer edge of the dial top plate 10 may be beveled at its edge as suggested at 42 to provide a smooth surface over which the tail end of the yarn may slide. As the tail end of the yarn is rotated progressively through the needle positions 20*a*, 20*b*, 20*c*, 20*d*, the tail end of the yarn slides along the space between the top plate 10 and the nozzle foot 32. This action progresses until the tail end of the yarn has been drawn into a cutting blade 44 which is exposed in a cutout portion 46 of the top plate 10. The cutting blade 44 extends over a portion of the teeth 40 of the disk 16 so that when the tail end of the yarn 30*a* which is caught in the teeth 40 reaches the cutting blade 44 it will be severed. The severed end of the yarn then is sucked up into the vacuum foot and through a hose 48 to a suitable filter trap (not shown). Thereafter, the knitting process continues with the yarn 30*a* being drawn continually into engagement with the rotating needles to knit the yarn into the fabric.

Figure 12:
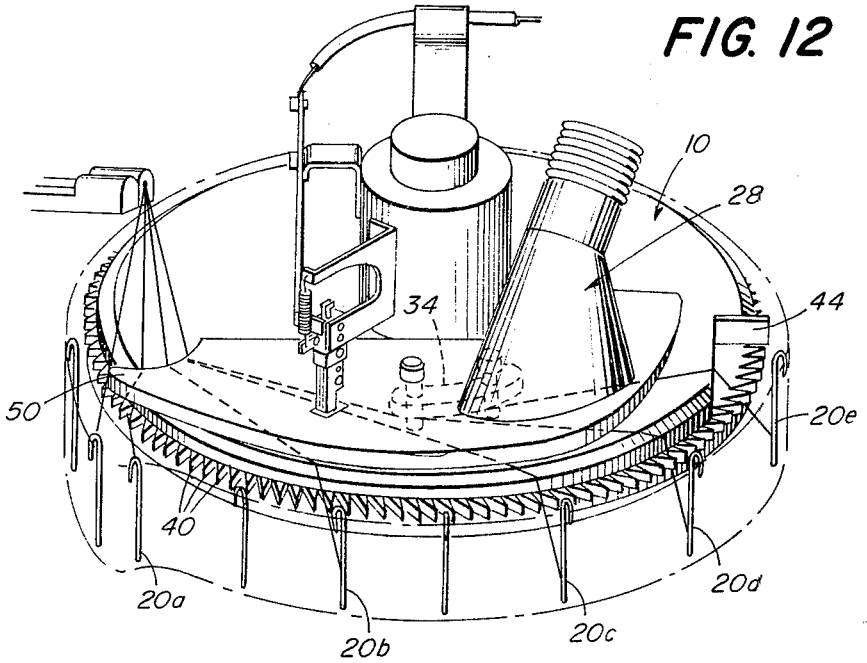
FIG. 12 is an illustration of the manner in which the yarn is detached from the knitting needles and showing the manner in which the yarn may be bound by a conventional vacuum nozzle.

When a yarn change is to be made, the yarn feed finger 26*a* is raised to its upper, remote position. This raises the yarn 30*a* above the level of the needles to preclude further engagement of the yarn 30*a* by subsequent needles. The yarn, however, does remain attached to the knitted fabric in the region where the last needle which engaged the yarn also engages the fabric so that as the needles and knitted fabric continue to rotate the yarn 30*a* will be drawn across the top of the top plate 10, between the plate 10 and the vacuum foot 28 as suggested in FIG. 12. The vacuum foot is provided with a radially, outwardly extending projection 50 which is positioned to engage the inwardly swinging portion of the yarn to guide it beneath the foot 32 and over the plate 10. As the needles continue to rotate the yarn will be engaged by one of the teeth 40 of the cutting disk 16. As the needle approaches the position indicated at 20*d*, the inwardly swinging yarn is wrapped about the yarn guide wall 34 and continues to wrap about the guide wall as the needle approaches the position indicated at 20*e*, at which time a substantial portion of the yarn will be disposed below the vacuum nozzle 28. The yarn then is in position to be cut by the cutting blade 44 which severs the yarn end from the knit fabric and enables the severed yarn end to be ingested into the vacuum nozzle and be held therein as suggested in FIG. 1 and in readiness to be reattached to the needles when desired. As the yarn feed finger 26*a* is raised, finger 26*b* is lowered to engage yarn 30*b* with the needles as described above.

Figure 4:
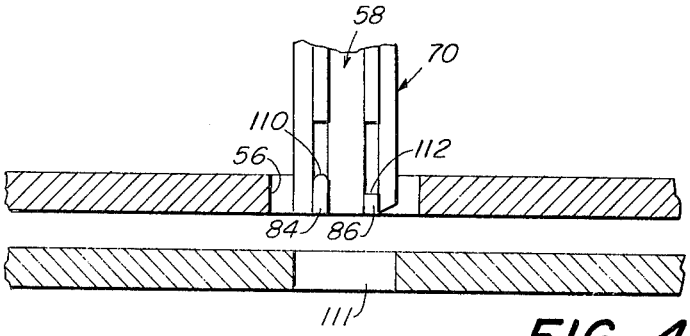
FIG. 4 is a sectional elevation seen along the line 4—4 of FIG. 2 and showing the lower end of the cutter-binder in a closed configuration.

As mentioned above, the foregoing arrangement of holding the end of the yarn by a vacuum nozzle is effective provided that the yarns are relatively inelastic. When the yarn is elasticized, however, and is maintained under tension throughout the knitting process, the suction exerted by the nozzle is insufficient to retain the cut yarn end because the yarn tends to contract substantially and under a substantially larger force than the suction can apply to it. In order to cut and effectively bind an elasticized yarn, the machine is modified to include an additional binder-cutter, indicated generally at 52 and located between the feed station and the nozzle 28. The binder-cutter 52 is mounted to the central boss 12 by a bracket 54 and extends downwardly from the bracket through an opening 56 formed in the nozzle foot 32 (see FIGS. 4 and 5). As described more fully below, the cutter-binder 52 includes a pair of jaws which are operative to bind and cut the end of the yarn. The jaws are movable from a retracted position as shown in FIG. 4 to an extended operative position shown in FIG. 5 in which the jaws extend downwardly through the space between the foot 32 and the top plate 10 where they may intersect and engage an elasticized yarn as it is drawn along the space between the foot and top plate.

Figure 8:
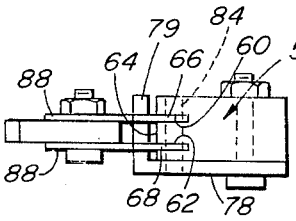
FIG. 8 is a plan view of the cutter-binder.
Figure 7:
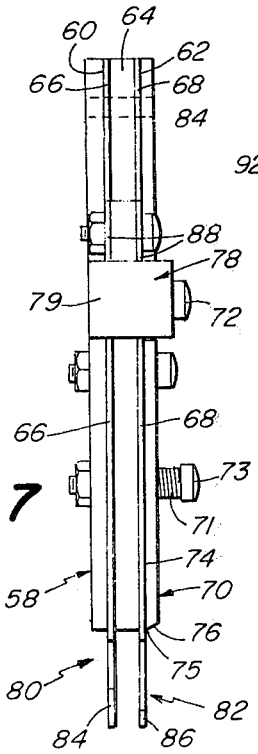
FIG. 7 is a front view of the cutter-binder.
Figure 6:
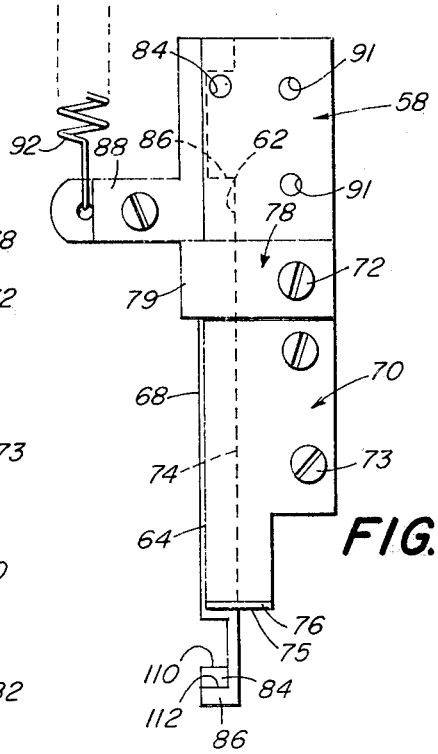
FIG. 6 is an enlarged side elevation of the cutter-binder.

FIGS. 6–8 show the binder-cutter attachment in enlarged detail. The device includes a body 58 having a pair of grooves 60, 62 formed along a face 64 of the body portion 58. A pair of slides 66, 68 are diposed within and extend along the grooves 60, 62 and are slidable therein. Groove 60, which receives slide 66 may extend fully along the length of the body while groove 62, which receives slide 68 may terminate above the bottom of the body member. A flat cutting blade 70 is secured to the body by a pair of screws 72, 73. A compression spring 71 may extend about the screw 73 to enable some adjustment to be made of the force with which the cutting blade 70 bears inwardly against the slide 68. The blade cooperates with the lower portion of the body 58 to define a lower continuation 74 of groove 62. The lower end of the cutting blade may be beveled upwardly and outwardly as shown at 76 to define a sharp cutting edge. The slides 66, 68 are retained within the grooves 60, 62 by an L-shaped retaining member 78 which is secured to the side of the body 58 by screw 72 and which has a portion 79 extending over the face 64 and in close proximity to the front edges of the slide 66, 68.

Figure 5:
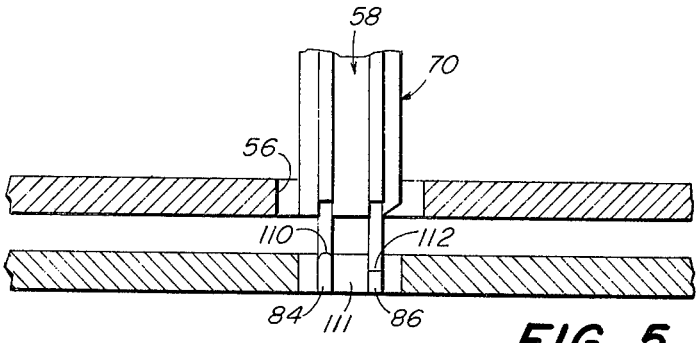
FIG. 5 is an illustration similar to FIG. 4 showing the lower end of the cutter-binder in an open, yarn-receptive configuration.

The lower ends of the slides 66, 68 are formed with cutout portions which define jaws 80, 82, each jaw including a forwardly extending finger 84, 86 both of said jaws having yarn engaging surfaces which are free of sharp edges capable of cutting the yarn. The slides 66, 68 are movable between a lower limit in which the jaws are fully extended as shown in FIGS. 5–7 and, an upper limit in which they are retracted into the grooves 60, 62 as shown in FIG. 4. The upper and lower limits of movement of the slides 66, 68 are determined by a pin 84 which extends through the body and intersects each of the grooves 60, 62 at their upper ends. Each of the slides 66, 68 has a cutout portion 86 which embraces the pin 84, the upper and lower ends of the cutout portion being movable into engagement with the pin to determine the upper and lower limits of movement of the slides. Each of the slides also includes a forwardly extending finger 88 between its ends and the fingers are secured together so that the slides will move in unison at all times. The attachment 52 may be mounted to the bracket 54 by screws 90 extending through the bracket and threaded into holes 91 of the body 58.

The slides 66, 68 are biased in an upward position to normally maintain the jaws in their retracted configuration, by a spring 92 which extends between an overhead portion 94 of the bracket 54 and the fingers 88 (FIG. 1). The jaws are movable from their normally retracted position to the open position shown in FIG. 5 by an actuating lever 96 which is pivoted at 98 to a bracket 100 which is in turn secured to the central boss 12. The end of the lever 96 is located above the fingers 88 so that when the end 102 of the lever 96 is pivoted downwardly it will drive the slides 66, 68 downwardly to their open position, overcoming the bias of the spring 92. The lever 96 is actuated by a cable 104 connected to the other end of the lever. The cable 104 is slideable in a sheath 106 and the sheath is secured in place by a bracket 108 mounted to the boss 12. The cable 104 is operated to pivot the end 102 of the lever 96 downwardly by connecting the cable to one of the numerous camming arrangements in the machine to operate the lever at the proper time.

Figure 9:
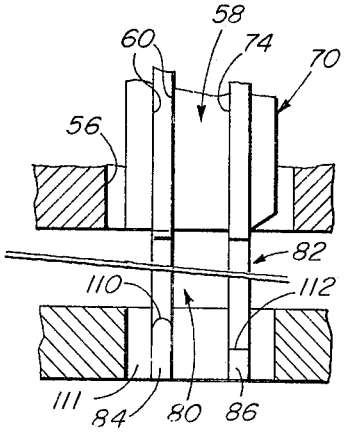
FIGS. 9—11 are sequential illustrations of the mode of operation of the cutter-binder.
Figure 13:
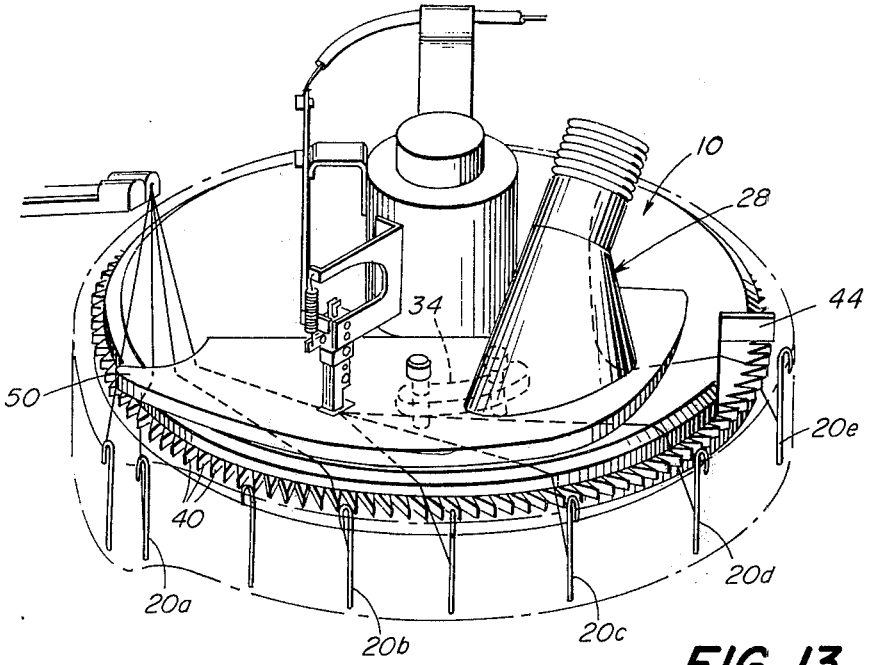
FIG. 13 is an illustration of the manner in which an elasticized yarn may be bound and cut in accordance with the invention.

In operation, the cutter-binder 52 is in its retracted inoperative configuration during the knitting process. If the yarn being knit into the fabric is relatively inelastic, that yarn may be detached from the needles in the manner described above by employing the cutting blade 44 and vacuum nozzle 28, the cutter-binder remaining inoperative. When the yarn being knitted into the fabric is an elasticized yarn and it is desired to change from the elasticized yarn to another yarn, the cutter-binder 52 is actuated through the actuating lever 96 to drive slides 66, 68 downwardly so that the jaws extend downwardly between the space between the top plate 10 and nozzle foot 32 as shown in FIGS. 5 and 9. The finger portions 84, 86 of the jaws are contained below the upper surface of the top plate in a receptive cutout 110 formed in the top plate so that when a yarn is passed over the top plate it may be drawn into and through the jaws and over the upper edges 110, 112 of the fingers 84, 86. When the yarn feed finger which controls the elasticized yarn then is raised, the yarn end will be drawn over the top plate 10 in the manner suggested in FIG. 12. The cutter-binder 52 is located so that as the yarn advances inwardly across the dial top plate 10 it will eventually extend through the open jaws 80, 82 as suggested in FIG. 13. The camming arrangement which times operation of the actuating lever 96 may be arranged to release the lever 96 just before the yarn is drawn into engagement with the cutting blade 44. This enables the spring 92 to close the jaws 80, 82 to cause the yarn to be cut and bound firmly. The yarn extending between the binder-cutter 52 and the raised yarn feed finger is held firmly in a remote position and in readiness to be reattached to the knitting needles later when desired. The severed portion of the yarn end contracts immediately upon being cut at the cutter-binder 52. The vacuum nozzle 28, however, is disposed generally between the cutter-binder 52 and the cutting blade 44 so that even though the severed end of the yarn does contract in length, it will still be long enough so that its free cut end may still be ingested at least partly into the nozzle (see FIG. 13). As the cutting disk 16 then draws the yarn end into engagement with the cutting blade 44, the yarn end portion is completely severed and is drawn away through the hose 48.

Figure 10:
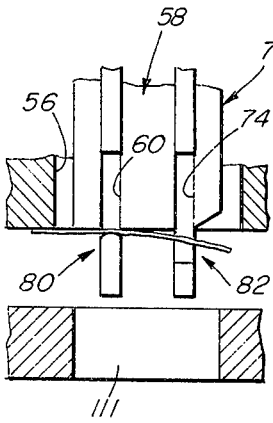
Figure 11:
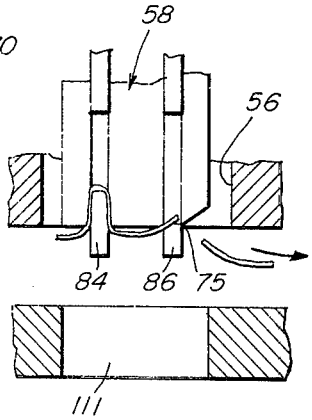

The action of the improved binder-cutter 52 is shown in enlarged detail in FIGS. 9–11. FIG. 9 shows the elastisized yarn just as it is drawn into the open jaws 80, 82. As shown in FIG. 10, when the actuating lever 96 is released to enable the spring 92 to draw the jaws upwardly, the binding jaw 80 which has an operating upper edge 110 higher than the corresponding upper edge 112 of the cutting jaw 82 will engage a portion of the yarn to urge it into the lower end of the groove 60. The yarn is thus drawn into a U-shaped configuration and is firmly gripped at two locations between the binding finger 84 and the opposite faces of the groove 60. The upper edge 110 of the binding finger 84 may be rounded smoothly to insure that no cutting action takes place at the binding jaw 80.

The foregoing arrangement has been found to be extremely effective to firmly grip the yarn, particularly elastisized yarns, so that when the yarn end is thereafter cut, it will not pull itself from the binding jaw 80. The yarn is cut by the cutting jaw 82 only after the binding jaw 80 has drawn the yarn into firm engagement into the groove 60. The cutting action, shown in FIG. 11, takes place when the yarn is drawn upwardly by the cutting jaw 82 into engagement with the cutting edge 75 of the cutting blade 70. The severed, free end of the yarn then contracts and is ingested into the vacuum nozzle 28 in readiness to be drawn upwardly through the hose when the other end of the severed yarn is cut at cutting blade 44. The yarn thus is cut at a location spaced beyond the location where it is firmly bound and in a manner which does not affect the firmness with which the bound end is held. It may also be noted that the yarn is cut before the binder jaw 80 has drawn the U-shaped portion of the yarn fully into its groove 60. Thus, the binder which already has effected a firm grip on the yarn continues to draw the U-shaped portion of the yarn further into the groove to increase its grip on the yarn. When so bound, the yarn will not tend to release or slide out from the binding jaw, as has been the case with the prior art devices.

Figure 14:
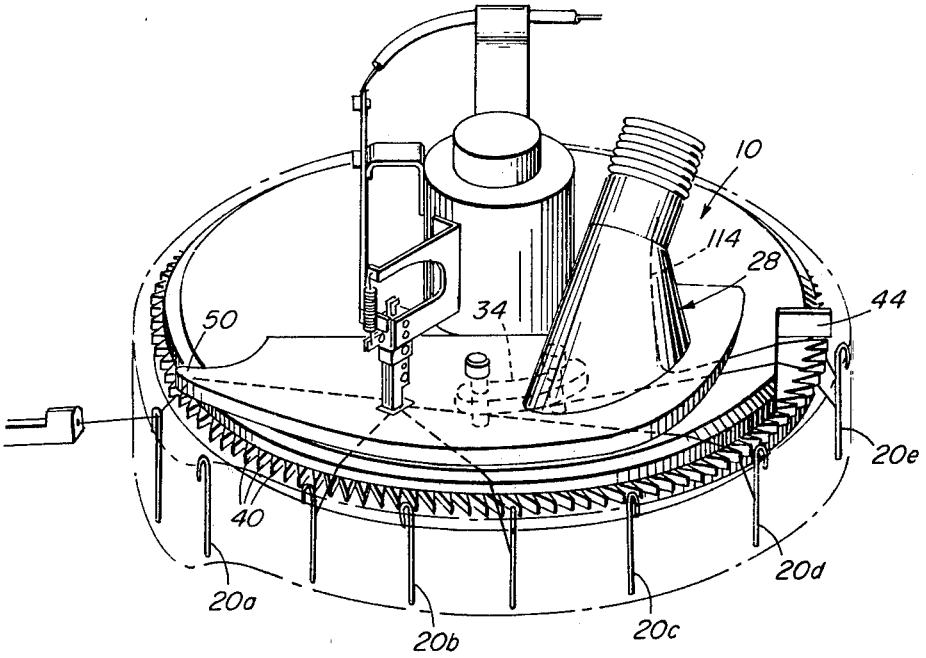
FIG. 14 is an illustration of the manner in which an elasticized yarn, bound and cut in accordance with the invention, may be reattached to the knitting needles and then trimmed.

When it is desired to reintroduce the elasticized yarn into the knitted fabric, the yarn feed finger is again moved downwardly into engagement with the needles as suggested in FIG. 14. The yarn also becomes engaged by one of the teeth of the cutting disk 16. As the needles and cutting disk continue to rotate, the binder-cutter 52 is maintained in its closed, yarn-holding configuration. As the portion of the yarn which extends from the binder 52 to the cutter disk is advanced with the rotation of the needles, that portion will be capable of stretching so that when the needle with which the yarn was last associated has advanced almost to the cutting blade 44, the yarn may stretch beneath the vacuum nozzle 28. Just before the yarn is drawn into engagement with the cutting blade 44, actuating arm 96 is operated to open the jaws 80, 82 and release the bound end of the yarn so that the yarn end may be ingested into the vacuum nozzle 28 as suggested at 114. When the yarn then is severed at its other end by blade 44, it then is drawn upwardly through the suction hose 48.

The invention has been described with regard to a simplified and somewhat diagrammatic dial assembly in which only one feeding station is shown. It should be understood that the invention may be employed, and is intended to be employed advantageously, in connection with multiple feed knitting machines which may have four or more feeding stations. One binder-cutter attachment of the type described is mounted in the machine for each feeding station where an elastisized yarn is to be employed. Moreover, while the invention has been described as being employed in a particular type of dial assembly having a cutting disk and blade of the type shown and a vacuum nozzle and guiding foot as shown, the cutter-binder is not limited to use in this specific type of configuration but may be employed in any of the variety of conventionally used knitting machines.

It should be understood that the foregoing description of the invention is intended merely to be illustrative thereof and that other modifications and embodiments may be apparent to those skilled in the art without departing from its spirit.

Having thus described the invention, what we desire to claim and secure by Letters Patent is:

1. A device for severing an end portion of a length of yarn and for holding the remaining portion of the yarn comprising:

a body member having an end surface, the body member having a passage extending therethrough that opens into the end surface;

a jaw member mounted for movement between a yarn receiving position in which the jaw member is spaced from the end surface of the body member and a yarn gripping position in which the jaw member is at least partly withdrawn into the passage;

said jaw member and said passage being dimensioned and being constructed and arranged to constrain a portion of the yarn in a U-shaped configuration and to grip each of the legs of said U-shaped portion of the yarn when the jaw member is in its yarn gripping position;

a cutting edge disposed on the body member and in spaced relation to the gripping jaw member and said passage;

a cutting jaw member mounted for movement in unison with the gripping jaw member, the cutting jaw member being movable from a position spaced from the cutting edge along a direction which extends past and in close proximity to the cutting edge; and said gripping jaw member, cutting jaw member and cutting edge being constructed and arranged as to delay cutting of the yarn until after the cutting jaw has at least partly gripped and partly formed the yarn into its U-shaped configuration.

2. A device as defined in claim 1 wherein said delayed operation of the cutting means is effected by means comprising:

said gripping and cutting jaw each having an upper edge, said upper edges being located with respect to each other and with respect to the location of the end of the passage and the cutting edge so that when the jaws are moved in unison the gripping jaw member will enter its opening before the cutting jaw member reaches the cutting edge.

3. A device as defined in claim 2 further comprising:

said jaws being dimensioned to cause the cutting jaw to reach the cutting edge before the gripping jaw member has been fully withdrawn within its passage whereby the yarn may be drawn further into the passage after the end portion has been severed.

4. A device for severing an end portion of a length of yarn and for holding the remaining portion of said length comprising:

a body member;

a pair of spaced parallel slots formed in the body member, the slots opening at an end of the body member;

a slide mounted in each of the slots for movement longitudinally therein, each of the slides having a jaw formed at its lower end thereof, the slides being connected for movement in unison with each other within their respective slots between an extended yarn-receiving position in which each of the jaws is spaced from the end of the body member and a retracted yarn binding and cutting position in which each of the jaws is withdrawn into its respective slot;

said body member and said jaws being dimensioned so that when the jaws are in said extended position, one of the jaws will have an upper edge disposed in closer proximity to the end of its respective slot than is the corresponding upper edge of the other of the jaws with respect to the end of its respective slot whereby when the jaws are moved in unison to their retracted positions, one of the jaws will enter its respective slot before the other jaw enters its respective slot; and a portion of the end of the last mentioned slot defining a cutting edge.

5. A device as defined in claim 4 further comprising:

a cutting member secured to the body and defining at least the lower portion of the last mentioned slot, said cutting edge being formed at the lower end of said cutting member.

6. A device as defined in claim 5 further comprising:

means for resiliently urging the cutting member toward its associated slot.

7. A device for use in a circular knitting machine to severe an end portion of a length of yarn and to hold the remaining portion of the yarn comprising:

a body member;

a first jaw and a second jaw, both mounted for movement in unison toward and away from the body member and between an extended position in which a length of yarn may be located between the jaws and the body member and a clamping position in which the first jaw grips the yarn in cooperation with the body member;

both of said jaws having yarn engaging surfaces which are free of sharp edges capable of cutting the yarn;

a cutting member mounted to the body member, the cutting member having a sharp edge and being disposed to cooperate with the second jaw to cut the yarn;

said jaws, body member and cutting member being constructed and arranged to delay cutting of the yarn until after the yarn has been clamped between said first jaw and the body member.

* * * * *